United States Patent [19]

Kudo et al.

[11] 4,400,349

[45] Aug. 23, 1983

[54] ALLOY FOR MAKING HIGH STRENGTH DEEP WELL CASING AND TUBING HAVING IMPROVED RESISTANCE TO STRESS-CORROSION CRACKING

[75] Inventors: Takeo Kudo, Suita; Yasutaka Okada, Nishinomiya; Taishi Moroishi, Kobe; Akio Ikeda, Hyogo; Hiroo Ohtani, Kobe; Kunihiko Yoshikawa, Suita, all of Japan

[73] Assignee: Sumitomo Metal Industries, Ltd., Osaka, Japan

[21] Appl. No.: 389,484

[22] Filed: Jun. 17, 1982

[30] Foreign Application Priority Data

Jun. 24, 1981 [JP] Japan ..... 56-97961
Jun. 24, 1981 [JP] Japan ..... 56-97962
Jun. 24, 1981 [JP] Japan ..... 56-97963

[51] Int. Cl.[3] ..... C22C 19/00

[52] U.S. Cl. ..... 420/443; 420/453; 420/454; 420/582; 420/584; 420/585; 420/586; 420/445; 420/446; 420/450

[58] Field of Search ..... 420/443, 452, 453, 454, 420/445, 446, 450, 451, 584, 585, 586

[56] References Cited

U.S. PATENT DOCUMENTS 3,495,977 2/1970 Denhard ..... 75/128 B
3,565,611 2/1971 Economy ..... 75/171
3,582,318 6/1971 Szumachowski ..... 75/122

*Primary Examiner*—L. Dewayne Rutledge
*Assistant Examiner*—Debbie Yee
*Attorney, Agent, or Firm*—Burns, Doane, Swecker and Mathis

[57] ABSTRACT

An alloy useful for manufacturing high strength oil-well casing, tubing and drill pipes for use in oil-well operations is disclosed. The alloy exhibits improved resistance to stress corrosion cracking in the $H_2S$—$CO_2$—$Cl^-$ environment, which comprises the following alloy composition:

| | | | |
|---|---|---|---|
| C: | ≦ 0.1% | Si: | ≦ 1.0% |
| Mn: | 3-20% | P: | ≦ 0.030% |
| S: | ≦ 0.005% | N: | 0-0.30% |
| sol. Al | ≦ 0.5% | Ni: | 20-60% |
| Cr: | 15-35% | Mo: | 0-12% |
| W: | 0-24% | | |

Cr(%) + 10 Mo(%) + 5 W(%) ≧ 50%
½ Mn(%) + Ni(%) ≧ 25%
1.5% ≦ Mo(%) + ½ W(%) ≦ 12%

| | | | |
|---|---|---|---|
| Cu: | 0-2.0% | Co: | 0-2.0% |
| Rare Earths: | 0-0.10% | Y: | 0-0.20% |
| Mg: | 0-0.10% | Ti: | 0-0.5% |
| Ca: | 0-0.10% | | |

Fe and incidental impurities: balance.

21 Claims, 5 Drawing Figures

BATH TEMP. : 150°C

Figure 1:
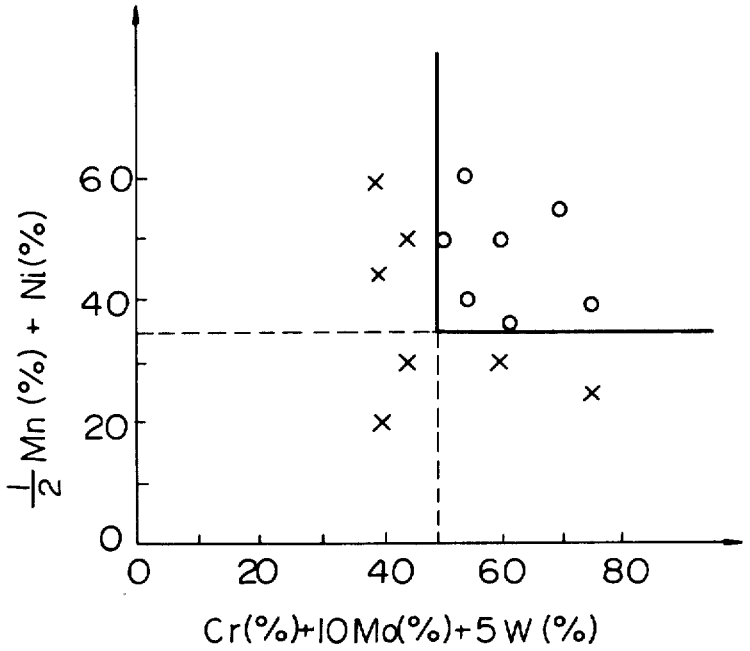

BASIC ALLOY COMPOSITION:

| C | Si | Mn | P | S |
|---|---|---|---|---|
| 0.01 | 0.2 | 5.0 | 0.010 | 0.001 |

BATH TEMP. : 200°C

BASIC ALLOY COMPOSITION:

| C | Si | Mn | P | S | N |
|---|---|---|---|---|---|
| 0.01 | 0.3 | 10.0 | 0.010 | 0.001 | 0.15 |

BATH TEMP. : 300 °C

BASIC ALLOY COMPOSITION:

| C | Si | Mn | P | S |
|---|---|---|---|---|
| 0.01 | 0.3 | 5.0 | 0.010 | 0.001 |

ALLOY FOR MAKING HIGH STRENGTH DEEP WELL CASING AND TUBING HAVING IMPROVED RESISTANCE TO STRESS-CORROSION CRACKING

This invention relates to an alloy composition which exhibits high strength as well as improved resistance to stress corrosion cracking and which is especially useful for manufacturing casing, tubing and drill pipes for use in deep wells for producing oil, natural gas, or geothermal water (hereunder referred to as "deep well" collectively).

Recently, in exploring for and reaching new sources of oil and natural gas, wells are being drilled deeper and deeper. Oil-wells 6000 meters or more are no longer unusual, and oil-wells 10,000 meters or more deep have been reported.

A deep well, therefore, is inevitably exposed to a severe environment. In addition to the high pressure, the environment of a deep well contains corrosive materials such as carbon dioxide and chlorine ions as well as wet hydrogen sulfide under high pressure.

Thus, casing, tubing and drill pipes (hereunder referred to as "casing and tubing", which mean, in general, oil country tubular goods) for use in oil-wells under such severe conditions must have high strength and improved resistance to stress corrosion cracking. In a general aspect, as one of the known measures used to prevent oil-well casing and/or tubing from stress corrosion cracking, it has been known in the art that a corrosion-suppressing agent called "inhibitor" is injected into the well. However, this measure to prevent corrosion cannot be used in all cases; for example, it is not applicable to offshore oil-wells.

Therefore, recently the use of a high-grade corrosion-resistant, high-alloy steel such as stainless steels, Incoloy (tradename) and Hastelloy (tradename) has been tried. However, the behavior of such materials under a corrosive environment including $H_2S$-$CO_2$-$Cl^-$ system like that found in deep oil-wells has not been studied thoroughly up to now.

U.S. Pat. No. 4,168,188 to Asphahani discloses a nickel base alloy containing 12–18% of molybdenum, 10–20% of chromium and 10–20% of iron for use in manufacturing well pipes and tubing. U.S. Pat. No. 4,171,217 to Asphahani et al also discloses a similar alloy composition in which this time the carbon content is limited to 0.030% maximum. U.S. Pat. No. 4,245,698 to Berkowitz et al discloses a nickel base superalloy containing 10–20% of molybdenum for use in sour gas or oil wells.

The object of this invention is to provide an alloy composition for use in manufacturing deep well casing and tubing which will have sufficient strength and high enough resistance to stress corrosion cracking to endure deep well drilling and/or a severely corrosive environment, especially that including $H_2S$-$CO_2$-$Cl^-$ system (hereunder referred to as "$H_2S$-$CO_2$-$Cl^-$-containing environment", or merely as "$H_2S$-$CO_2$-$Cl^-$-environment").

Figure 2:
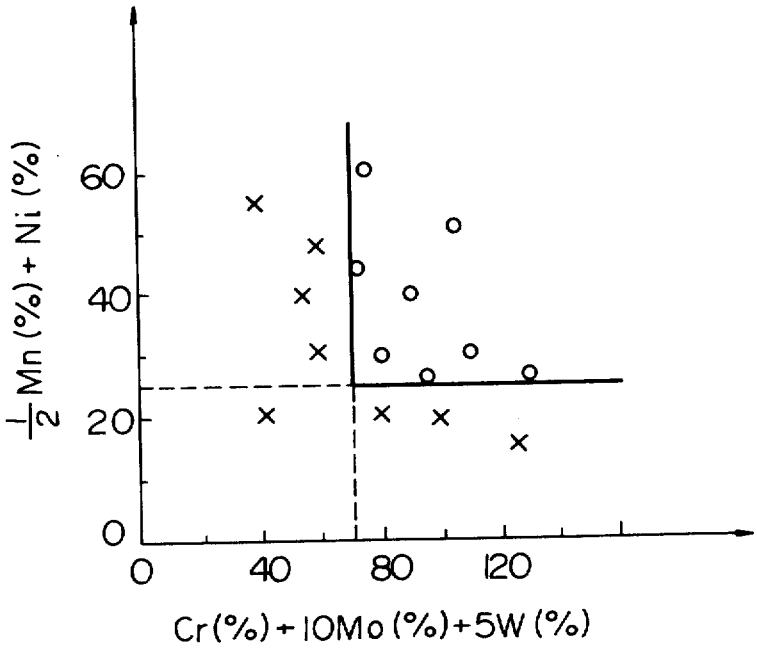
Figure 3:
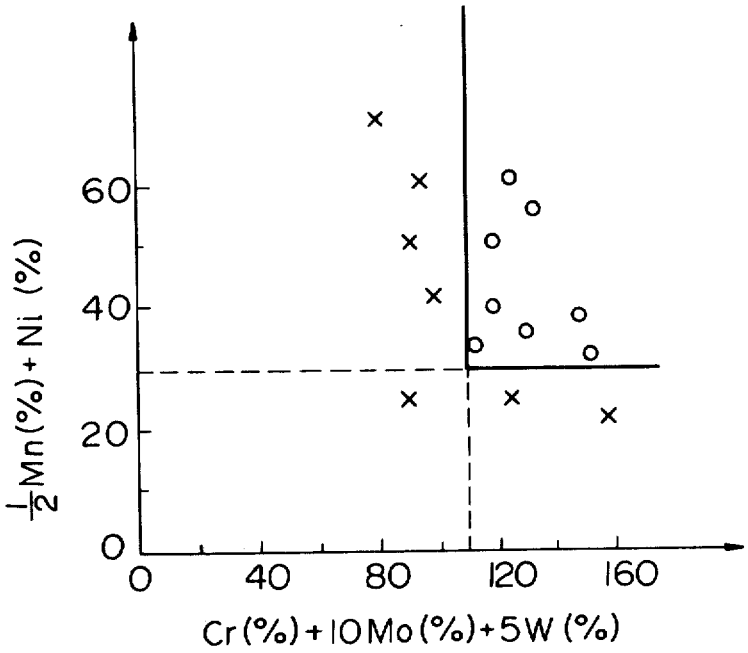
Figure 4:
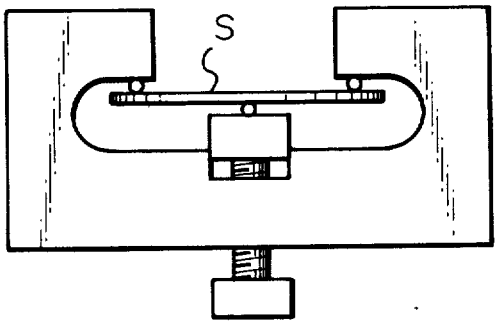
Figure 5:
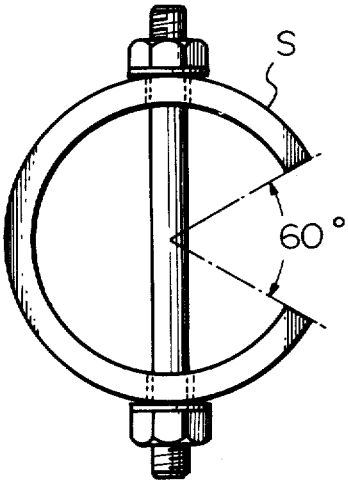

FIG. 1 through FIG. 3 show the relationship between $\frac{1}{2}Mn(\%)+Ni(\%)$ and $Cr(\%)+10Mo(\%)+5W(\%)$ with respect to the resistance to stress corrosion cracking; FIG. 4 is a schematic view of a specimen held by a three-point supporting beam-type jig; and FIG. 5 is a schematic view of a testing sample put under tension by using a bolt and nut.

In the course of our research we found the following:

(a) Under corrosive environments containing $H_2S$, $CO_2$ and chloride ions ($Cl^-$), corrosion proceeds mainly by way of stress corrosion cracking. The mechanism of stress corrosion cracking in those cases, however, is quite different from that generally found in austenitic stainless steels. That is, the primary cause of the stress corrosion cracking in the case of austenitic stainless steel is the presence of chloride ions ($Cl^-$). In contrast, the primary cause of such stress corrosion cracking as found in casing and/or tubing in deep oil-wells, is the presence of $H_2S$, although the presence of $Cl^-$ ions is also a factor.

(b) Alloy casing and tubing to be used in deep oil-wells are usually subjected to cold working in order to improve strength. However, cold working seriously decreases the resistance to stress corrosion cracking.

(c) The corrosion rate of an alloy in a corrosive $H_2S$-$CO_2$-$Cl^-$-environment depends on the Cr, Ni, Mo, Mn and W content of the alloy. If the casing or tubing has a surface layer comprised of these elements, the alloy not only has better resistance to corrosion in general, but also it has improved resistance to stress corrosion cracking even under such a corrosive environment as that found in deep oil-wells. Specifically, we found that molybdenum is 10 times as effective as chromium, molybdenum is twice as effective as tungsten and manganese is as effective as $\frac{1}{2}$Ni. Thus, we found that chromium(%), tungsten(%), molybdenum(%) and manganese(%) should be satisfied by the equations:

$$Cr(\%)+10Mo(\%)+5W(\%)\geqq 50\%$$

$$\tfrac{1}{2}Mn(\%)+Ni(\%)\geqq 25\%$$

$$1.5\%\leqq Mo+\tfrac{1}{2}W(\%)\leqq 12\%$$

In addition, the nickel content is from 20% to 60%, the chromium content is from 15% to 35% and the manganese content is from 3% to 20%, preferably from 3% to 15%. Then even after having been subjected to cold working, the resulting alloy surface layer retains markedly improve resistance to corrosion in an extremely corrosive $H_2S$-$CO_2$-$Cl^-$ environment.

More specifically, when the alloy is used in an extremely corrosive $H_2S$-$CO_2$-$Cl^-$ environment as in deep oil-wells, especially at a temperature of 150° C. or less, it is desirable that the proportions of chromium(%), tungsten(%), molybdenum(%) and manganese(%) be satisfied by the equations:

$$Cr(\%)+10Mo(\%)+5W(\%)\geqq 50\%$$

$$\tfrac{1}{2}Mn(\%)+Ni(\%)\geqq 35\%$$

$$1.5\%\leqq Mo(\%)+\tfrac{1}{2}W(\%)<4\%$$

wherein, the Ni content is 25–60%, preferably 35–60%, and the Cr content is 22.5–35%, preferably 24–35%.

When the alloy is used in an extremely corrosive $H_2S$-$CO_2$-$Cl^-$ environment as in deep oil-wells, especially at a temperature of 200° C. or less, it is desirable that the proportions of chromium(%), tungsten(%), molybdenum(%) and manganese(%) be satisfied by the equations:

$$Cr(\%)+10Mo(\%)+5W(\%)\geqq 70\%$$

$$\tfrac{1}{2}Mn(\%)+Ni(\%)\geqq 25\%$$

$$4\%\leqq Mo(\%)+\tfrac{1}{2}W(\%)<8\%$$

wherein the Ni content is 20–60%, preferably 35–60% and the Cr content is 22.5–30%, preferably 24–30%.

Furthermore, when the alloy is used in an extremely corrosive $H_2S$-$CO_2$-$Cl^-$ environment as in deep oil-wells, especially at a temperature of 200° C. or higher, the proportions of chromium(%), tungsten(%), molybdenum(%) and manganese(%) are desirably satisfied by the equations:

$$Cr(\%)+10Mo(\%)+5W(\%)\geqq 110\%$$

$$\tfrac{1}{2}Mn(\%)+Ni(\%)\geqq 30\%$$

$$8\%\leqq Mo(\%)+\tfrac{1}{2}W(\%)\leqq 12\%$$

wherein the Ni content is 20–60%, preferably 40–60% and the Cr content is 15–30%.

(d) The addition of nickel is effective not only to improve the resistance of the surface layer to stress corrosion cracking, but also to improve the metallurgical structure itself of the alloy. Thus, the addition of nickel results in markedly improved resistance to stress corrosion cracking.

(e) When nitrogen in an amount within the range of 0.05–0.30% is intentionally added to the alloy as an alloying element, the strength of the resulting steel is further improved. A preferred nitrogen content is from 0.05–0.25%.

(f) Sulfur is an incidental impurity, and when the S content is not more than 0.0007%, hot workability of the resulting alloy is markedly improved.

(g) Phosphorous, too, is an incidental impurity, and when the P content is not more than 0.003%, the susceptibility to hydrogen embrittlement is markedly reduced.

(h) When Cu in an amount of not more than 2.0% and/or Co in an amount of not more than 2.0% is added to the alloy as additional alloying elements, the resistance to corrosion is further improved.

(i) When one or more of the following alloying elements is added to the alloy in the proportion indicated, the hot workability is further improved: rare earths, not more than 0.10%; Y, not more than 0.2%; Mg, not more than 0.10%; Ti, not more than 0.5%; and Ca, not more than 0.10%.

This invention has been completed on the basis of the discoveries mentioned above, and resides in an alloy for manufacturing high strength deep well casing and tubing having improved resistance to stress corrosion cracking, the alloy composition comprising:

| | | | |
|---|---|---|---|
| C: | not more than 0.1%, preferably not more than 0.05% | | |
| Si: | not more than 1.0% | | |
| Mn: | 3–20%, preferably 3–15% | | |
| P: | not more than 0.030% | S: | not more than 0.005% |
| Ni: | 20–60% | Cr: | 15–35% |

one or more of Mo: not more than 12%, and W: not more than 24%, with the following equations being satisfied;

$$Cr(\%)+10Mo(\%)+5W(\%)\geqq 50\%$$

$$\tfrac{1}{2}Mn(\%)+Ni(\%)\geqq 25\%$$

$$1.5\%-Mo+\tfrac{1}{2}W(\%)\leqq 12\%$$

and the balance iron with incidental impurities.

The alloy of this invention may further comprise any combinations of the following:

(i) Cu, not more than 2.0%, and/or Co, not more than 2.0%.

(ii) One or more of rare earths, not more than 0.10%; Y, not more than 0.20%; Mg, not more than 0.10%; Ti, not more than 0.5%; and Ca, not more than 0.10%.

(iii) Nitrogen in an amount of 0.05–0.30%, preferably 0.05–0.25% may be intentionally added to the alloy.

(iv) For the purpose of further improving the resistance to hydrogen embrittlement, the P content is desirably not more than 0.003%.

(v) The S content is preferably not more than 0.007% so as to further improve the hot workability.

Therefore, in a broad aspect, this invention resides in an alloy for manufacturing high strength deep well casing and tubing having improved resistance to stress corrosion cracking, which comprises:

| | | | |
|---|---|---|---|
| C: | ≦0.1% | Si: | ≦1.0% |
| Mn: | 3–20% | P: | ≦0.030% |
| S: | ≦0.005% | N: | 0–0.30% |
| Sol. Al ≦ 0.5% | | Ni: | 20–60% |
| Cr: | 15–35% | Mo: | 0–12% |
| W: | 0–24% | | |
| | Cr (%) + 10Mo (%) + 5W (%) ≧ 50% | | |
| | ½Mn (%) + Ni (%) ≧ 25% | | |
| | 1.5% ≦ Mo + ½W (%) ≦ 12% | | |
| Cu: | 0–20% | Co: | 0–2.0% |
| Rare Earths: 0–0.10% | | Y: | 0–0.20% |
| Mg: | 0–0.10% | Ti: | 0–0.5% |
| Ca: | 0–0.10% | | |
| Fe and incidental impurities: balance. | | | |

In a preferred embodiment this invention covers the following compositions:

| | | | | |
|---|---|---|---|---|
| (I) | C: | ≦0.1%, preferably ≦ 0.05% | | |
| | Si: | ≦1.0% | | |
| | Mn: | 3–20%, preferably 3–15% | | |
| | P: | ≦0.030% | S: | ≦0.005% |
| | N: | 0–0.30% | Sol. Al ≦ 0.5% | |
| | Ni: | 25–60%, preferably 35–60% | | |
| | Cr: | 22.5–35%, preferably 24–35% | | |
| | Mo: | 0–4% (excl.) | W: | 0–8% (excl.) |
| | | Cr (%) + 10Mo (%) + 5W (%) ≧ 50% | | |
| | | ½Mn (%) + Ni (%) ≧ 35% | | |
| | | 1.5% ≦ Mo + ½W (%) < 4% | | |
| | Cu: | 0–2.0% | Co: | 0–2.0% |
| | Rare Earths: 0–0.10% | | Y: | 0–0.20% |
| | Mg: | 0–0.10% | Ti: | 0–0.5% |
| | Ca: | 0–0.10% | | |
| | Fe and incidental impurities: balance; | | | |
| (II) | C: | ≦0.1%, preferably ≦ 0.05% | | |
| | Si: | ≦1.0% | | |
| | Mn: | 3–20%, preferably 3–15% | | |
| | P: | ≦0.030% | S: | ≦0.005% |
| | N: | 0–0.30% | sol.Al ≦ 0.5% | |
| | Ni: | 20–60%, preferably 35–60% | | |
| | Cr: | 22.5–30%, preferably 24–30% | | |
| | Mo: | 0–8% (excl.) | W: | 0–16% (excl.) |
| | | Cr (%) + 10Mo (%) + 5W (%) ≧ 70% | | |
| | | ½Mn (%) + Ni (%) ≧ 25% | | |
| | | 4% ≦ Mo + ½W (%) < 8% | | |
| | Cu: | 0–2.0% | Co: | 0–2.0% |
| | Rare Earths: 0–0.10% | | Y: | 0–0.20% |
| | Mg: | 0–0.10% | Ti: | 0–0.5% |
| | Ca: | 0–0.10% | | |
| | Fe and incidental impurities: balance; and | | | |

-continued

| | | | | |
|---|---|---|---|---|
| (III) | C: | ≤0.1%, preferably ≤ 0.05% | | |
| | Si: | ≤1.0% | | |
| | Mn: | 3-20%, preferably 3-15% | | |
| | P: | ≤0.030% | S: | ≤0.005% |
| | N: | 0-0.30% | sol.Al | ≤ 0.5% |
| | Ni: | 20-60%, preferably 40-60% | | |
| | Cr: | 15-30% | Mo: | 0-12% |
| | W: | 0-24% | | |
| | | Cr (%) + 10Mo (%) + 5W (%) ≥ 110% | | |
| | | ½Mn (%) + Ni (%) ≥ 30% | | |
| | | 8% ≤ Mo + ½W (%) ≤ 12% | | |
| | Cu: | 0-2.0% | Co: | 0-2.0% |
| | Rare Earths: | 0-0.10% | Y: | 0-0.20% |
| | Mg: | 0-0.10% | Ti: | 0-0.5% |
| | Ca: | 0-0.10% | | |
| | Fe and incidental impurities: balance. | | | |

Now, the reasons for defining the alloy composition of this invention as in the above will be described:

Carbon (C)

When the carbon content is over 0.1%, the alloy is rather susceptible to stress corrosion cracking at grain boundaries. The upper limit of the carbon content is 0.10%. The carbon content is preferably not more than 0.05%.

Silicon (Si)

Si is a necessary element as a deoxidizing agent. However, when it is more than 1.0%, hot workability of the resulting alloy deteriorates. The upper limit thereof is defined as 1.0%.

Manganese (Mn)

It is necessary to add Mn in an amount of 3% of more so as to obtain a desired level of resistance to stress corrosion cracking together with superior ductility and toughness. On the other hand, when the Mn content is over 20%, the hot workability and toughness deteriorates remarkably. Thus, according to this invention, the Mn content is from 3% to 20%, preferably from 3% to 15%.

Phosphorous (P)

P is present in the alloy as an impurity. The presence of P in an amount of more than 0.030% causes the resulting alloy to be susceptible to stress corrosion cracking. Therefore, the upper limit of P is defined as 0.030%, so that susceptibility to stress corrosion cracking may be kept at a lower level. It is to be noted that when the P content is reduced beyond the point of 0.003%, the susceptibility to hydrogen embrittlement is dramatically improved. Therefore, it is highly desirable to reduce the P content to 0.003% or less when it is desired to obtain an alloy with remarkably improved resistance to hydrogen embrittlement.

Sulfur (S)

When the amount of S, which is present in alloy as an incidental impurity, is over 0.005%, the hot workability deteriorates. So, the mount of S in alloy is restricted to not more than 0.005% in order to prevent deterioration in hot workability. When the amount of S is reduced to 0.0007% or less, the hot workability is dramatically improved. Therefore, where hot working under severe conditions is required, it is desirable to reduce the S content to 0.0007% or less.

Aluminum (Al)

Al, like Si is effective as a deoxidizing agent. In addition, since Al does not have any adverse effect on properties of the alloy, the presence of Al in an amount of up to 0.5% as sol. Al may be allowed.

Nickel (Ni)

Ni is effective to improve the resistance to stress corrosion cracking. When nickel is added in an amount of less than 20%, however, it is impossible to impart a sufficient degree of resistance to stress corrosion cracking. On the other hand, when it is added in an amount of more than 60%, the resistance to stress corrosion cracking cannot be further improved. Thus, in view of economy of material the nickel content is restricted to 20-60% in its broad aspect.

Chromium (Cr)

Cr is effective to improve the resistance to stress corrosion in the presence of Ni, Mo, Mn and W. However, less than 15% of Cr does not contribute to improvement in hot workability, and it is necessary to add such other elements as Mo and W in order to keep a desired level of resistance to stress corrosion cracking. From an economical viewpoint, therefore, it is not desirable to reduce the amount of Cr so much. The lower limit of the Cr content is defined as 15%. On the other hand, when Cr is added in an amount of more than 35%, hot workability deteriorates, even when the amount of S is reduced to less than 0.0007%. The upper limit thereof is 35%.

Molybdenum (Mo) and Tungsten (W)

As already mentioned, both elements are effective to improve the resistance to stress corrosion cracking in the presence of Ni, Mn and Cr. However, generally speaking, when Mo and W are respectively added in amounts of more than 12% and more than 24%, the corrosion resistance properties cannot be improved any more under the $H_2S$-$CO_2$-$Cl^-$ environment. More particularly, the addition of Mo and W in amounts of more than 12% and more than 24%, respectively, does not result in an improvement any more at a temperature of 200° C. or higher; more than 8% and more than 16%, respectively, at a temperature of 200° C. or lower; and more than 4% and more than 8%, respectively at a temperature of 150° C. or lower. Therefore, by considering the economy of material, Mo may be added in an amount of not more than 12%, or less than 8%, or less than 4%, and W may be added in an amount of not more than 24%, or less than 16%, or less than 8% depending on the severity of a corrosive environment in which the casing and/or tubing made of an alloy of this invention is used.

Regarding the Mo and W content, we have introduced the equation: $Mo(\%)+\frac{1}{2}W(\%)$. This is because, since the atomic weight of W is twice the atomic weight of Mo, Mo is equal to ½W with respect to improvement in the resistance to stress corrosion cracking.

When the value of this equation is less than 8%, it is impossible to obtain the desired level of resistance to stress corrosion cracking, particularly at a temperature of 200° C. or higher under the severe $H_2S$-$CO_2$-$Cl^-$ environment. On the other hand, when the value is larger than 12%, this means that an excess amount of Mo or W is added and is not desirable from an economical viewpoint.

When the value of this equation is less than 4%, it is impossible to obtain the desired level of resistance to stress corrosion cracking at a temperature of 200° C. or lower under the severe $H_2S$-$CO_2$-$Cl^-$ environment. On the other hand, when the value is 8% or larger, this means that an excess amount of Mo or W is added and is not desirable from an economical viewpoint in such a severe environment at a temperature of 200° C. or lower.

When the value of this equation is less than 1.5%, it is impossible to obtain a sufficient level of resistance to stress corrosion cracking at a temperature of 150° C. or lower under the severe $H_2S$-$CO_2$-$Cl^-$ environment. On the other hand, when the value is 4% or larger, this means that an excess amount of Mo or W is added and is not desirable from an economical viewpoint in such a corrosive environment at a temperature of 150° C. or lower.

Nitrogen (N)

When N is intentionally added to the alloy, N is effective to improve the strength of the resulting alloy due to solid solution hardening. N is also effective to prevent the occurrence of embrittlement which is caused by the addition of manganese. When the N content is less than 0.05%, it is not effective to impart a desired level of strength to the alloy. On the other hand, it is rather difficult to prepare the melt and ingot of the alloy, if N is added in an amount of more than 0.30%. Thus, according to this invention, the N content, when it is added, is defined as within 0.05-0.30%, preferably 0.05-0.25%.

Copper (Cu) and Cobalt (Co)

Cu and Co are effective to improve corrosion resistance of the alloy of this invention. Therefore, Cu and/or Co may be added when especially high corrosion resistance is required. However, the addition of Cu in an amount of more than 2.0% tends to lower the hot workability. The addition of Co in an amount of more than 2.0% does not result in any additional improvement. The upper limit each of them is 2.0%.

Rare Earths, Y, Mg, Ti and Ca

They are all effective to improve hot workability. Therefore, when the alloy has to be subjected to severe hot working, it is desirable to incorporate at least one of these elements in the alloy. However, rare earths in an amount of more than 0.10%, or Y more than 0.20%, or Mg more than 0.10%, or Ti more than 0.5%, or Ca more than 0.10% is added, there is no substantial improvement in hot workability. Rather, deterioration in hot workability is sometimes found.

Thus, the addition of these elements is limited to not more than 0.10% for rare earths, 0.20% for Y, 0.10% for Mg, 0.5% for Ti and 0.10% for Ca.

Furthermore, according to this invention, the amounts of Cr, Ni, Mn, Mo and W are also restricted by the following equations:

$$Cr(\%)+10Mo(\%)+5W(\%), \text{ and}$$

$$\tfrac{1}{2}Mn(\%)+Ni(\%)$$

FIGS. 1-3 show the relationship between $Cr(\%)+10Mo(\%)+5W(\%)$ and $\frac{1}{2}Mn(\%)+Ni(\%)$ with respect to the resistance to stress corrosion cracking under severe corrosive conditions.

In order to obtain the data shown in FIGS. 1-3, a series of Cr-Ni-Mn-Mo alloys, Cr-Ni-Mo-W alloys and Cr-Ni-Mn-Mo-W alloys, in each of which the proportions of Cr, Ni, Mn, Mo and W were varied, were prepared, cast, forged and hot rolled to provide alloy plates 7 mm thick. The resulting plates were thereafter subjected to solid solution treatment at 1050° C. for 30 minutes and then water-cooled. After finishing the solid solution treatment cold working was applied with a reduction in thickness of 22% in order to improve its strength. Specimens (2 mm thickness×10 mm width×75 mm length) were cut from the cold rolled sheet in a direction perpendicular to the rolling direction.

Each of these specimens was held on a three-point supporting beam-type jig as shown in FIG. 4. Thus, the specimen S under tension at a level of a tensile stress corresponding to 0.2% offset yield strength was subjected to the stress corrosion cracking test. Namely, the specimen together with said jig were soaked in a 20% NaCl solution (bath temperature: 150° C., 200° C. and 300° C.) saturated by $H_2S$ and $CO_2$ at a pressure of 10 atms, respectively, for 1000 hours.

After soaking for 1000 hours, the formation of cracks was visually examined. The resulting data indicates that there is a definite relationship, as shown in FIGS. 1-3, between the equation: $\frac{1}{2}Mn(\%)+Ni(\%)$ and the equation: $Cr(\%)+10Mo(\%)+5W(\%)$, which are parameters first conceived by the inventors of this invention, with respect to the resistance to stress corrosion cracking.

According to the data shown in FIGS. 1-3, the following has been noted:

In case where the bath temperature is 150° C. or lower, a desired level of the resistance to stress corrosion cracking is obtained as long as the following equations are satisfied:

$$Cr(\%)+10Mo(\%)+5W(\%)\geqq 50\%$$

$$\tfrac{1}{2}Mn(\%)+Ni(\%)\geqq 35\%$$

In case where the bath temperature is 200° C. or lower, the following equations are desirably satisfied;

$$Cr(\%)+10Mo(\%)+5W(\%)\geqq 70\%$$

$$\tfrac{1}{2}Mn(\%)+Ni(\%)\geqq 25\%$$

In addition, in case where the bath temperature is 300° C. or higher than 200° C., the following equations are desirably satisfied;

$$Cr(\%)+10Mo(\%)+5W(\%)\geqq 110\%$$

$$\tfrac{1}{2}Mn(\%)+Ni(\%)\geqq 30\%$$

In FIGS. 1-3, the symbol "O" shows the case in which there was no substantial cracking and "X" indicates the occurrence of cracking. As is apparent from the data shown in FIGS. 1-3, alloy articles manufactured in accordance with this invention can exhibit markedly improved resistance to stress corrosion cracking under server conditions.

The alloy composition of this invention may include as incidental impurities B, Sn, Pb, Zn, etc. each in an amount of less than 0.1% without rendering any adverse effect on the properties of the alloy.

Thus, according to this invention, it is possible to manufacture deep well casing, tubing and drill pipes etc., for example, which have a 0.2% offset yield strength of 80 kg/mm$^2$, preferably 85 kg/mm$^2$ or more as well as good ductility and toughness and which have excellent resistance to stress corrosion cracking.

This invention will be further described in conjunction with working examples, which are presented as specific illustrations of the claimed invention. It should be understood, however, that the invention is not limited to the specific details set forth in the example.

EXAMPLES

Molten alloys each having respective alloy compositions shown in Tables 1, 3 and 5 were prepared by using a combination of a conventional electric arc furnace, an Ar-Oxygen decarburizing furnace (AOD furnace) when it is necessary to carry out desulfurization and nitrogen addition, and an electro-slag remelting furnace (ESR furnace) when it is necessary to carry out dephosphorization. The thus prepared molten alloy was then cast into a round ingot having a diameter of 500 mm, to which hot forging was applied at a temperature of 1200° C. to provide a billet 150 mm in diameter.

During the hot forging the billet was visually examined for the formation of cracks for the purpose of evaluating the hot workability of the alloy. The billets were then subjected to hot extrusion to provide a pipe having a dimension of 60 mm diameter×4 mm wall thickness, and the thus obtained pipe was then subjected to cold drawing with a reduction of area of 22%. The resulting pipe was 55 mm in diameter and had a wall thickness of 3.1 mm.

Thus, pipes of this invention alloy, comparative ones in which some of their alloying elements are outside the range of this invention, and conventional ones were prepared. Conventional Alloys Nos. 1 through 4 correspond to SUS 316(JIS), SUS 310 S(JIS), Incoloy 800 and SUS 329 J1(JIS), respectively.

A ring-shaped specimen 20 mm long was cut from each of those pipes and then a portion of the circumferential length of the ring corresponding to the angle of 60° was cut off as shown in FIG. 5. The thus obtained test specimens was put under tension on the surface thereof at a tensile stress level corresponding to 0.2% off-set yield strength by means of a bolt and nut provided through the opposite wall portions of the ring. The specimen together with the bolt and nut were soaked in a 20% NaCl solution (bath temp. 150° C., 200° C., 300° C.) for 1000 hours. The solution was kept in equilibrium with the atmosphere wherein the $H_2S$ partial pressure was 0.1 atm, or 1 atm, or 15 atms and the partial pressure of $CO_2$ is 10 atms. After finishing the stress corrosion cracking test in said NaCl solution, it was determined whether or not stress corrosion cracking had occurred. The test results are summarized in Tables 2, 4 and 6 together with the test results of cracking during hot forging and experimental data of some mechanical properties. In each column in Tables 2, 4 and 6, the symbol "O" indicates the case where there was no cracking, and the symbol "X" shows the case where cracking occurred.

As is apparent from the experimental data, the comparative pipes do not meet the standards for any one of hot workability, tensile strength and stress corrosion cracking resistance. On the other hand, the pipes of this invention alloy are satisfactory respect to all those properties. Namely, the pipes made of this invention alloy have a desired level of mechanical strength and resistance to stress corrosion cracking as well as satisfactory hot workability, and those properties are also superior to those of the conventional pipes made of conventional alloys.

TABLE 1

| | Alloy No. | This invention (Weight %) | | | | | | | | | | | |
|---|---|---|---|---|---|---|---|---|---|---|---|---|---|
| | | C | Si | Mn | P | S | Sol.Al | Ni | Cr | Mo | W | Others | |
| This invention | 1 | 0.01 | 0.23 | 3.3 | 0.025 | 0.002 | 0.16 | 50.6 | 27.6 | 3.0 | — | — | (N: 0.012) |
| | 2 | 0.02 | 0.38 | 11.0 | 0.021 | 0.003 | 0.12 | 42.3 | 30.2 | 2.5 | — | — | (N: 0.023) |
| | 3 | 0.03 | 0.09 | 19.5 | 0.016 | 0.001 | 0.09 | 28.5 | 31.5 | 2.2 | 0.6 | — | (N: 0.017) |
| | 4 | 0.02 | 0.43 | 19.1 | 0.011 | 0.002 | 0.19 | 25.9 | 27.8 | 3.3 | — | — | (N: 0.038) |
| | 5 | 0.009 | 0.25 | 6.7 | 0.013 | 0.003 | 0.22 | 59.6 | 28.4 | 2.6 | — | — | (N: 0.009) |
| | 6 | 0.01 | 0.31 | 5.9 | 0.003 | 0.005 | 0.13 | 38.1 | 23.0 | 2.0 | 1.5 | — | (N: 0.018) |
| | 7 | 0.02 | 0.27 | 6.8 | 0.025 | 0.0004 | 0.24 | 46.3 | 34.3 | 2.8 | — | — | (N: 0.023) |
| | 8 | 0.04 | 0.16 | 5.2 | 0.016 | 0.001 | 0.21 | 45.6 | 33.5 | 1.8 | — | — | (N: 0.016) |
| | 9 | 0.01 | 0.38 | 3.8 | 0.013 | 0.002 | 0.10 | 51.2 | 26.5 | 3.8 | — | — | (N: 0.031) |
| | 10 | 0.02 | 0.20 | 6.0 | 0.011 | 0.001 | 0.09 | 46.5 | 28.5 | 1.3 | 2.8 | — | (N: 0.019) |
| | 11 | 0.02 | 0.06 | 4.5 | 0.017 | 0.002 | 0.25 | 33.2 | 34.4 | — | 3.2 | — | (N: 0.020) |
| | 12 | 0.02 | 0.31 | 5.6 | 0.009 | 0.0006 | 0.31 | 40.9 | 25.8 | — | 7.9 | — | (N: 0.024) |
| | 13 | 0.01 | 0.04 | 10.2 | 0.011 | 0.002 | 0.12 | 36.2 | 27.9 | 2.9 | — | Cu: 1.8 | (N: 0.011) |
| | 14 | 0.03 | 0.25 | 6.0 | 0.021 | 0.001 | 0.16 | 33.5 | 31.6 | 3.1 | 1.4 | Co: 1.9 | (N: 0.025) |
| | 15 | 0.01 | 0.26 | 4.9 | 0.017 | 0.003 | 0.14 | 40.8 | 29.4 | 2.7 | — | La + Ce: 0.027 | (N: 0.032) |
| | 16 | 0.01 | 0.39 | 5.1 | 0.010 | 0.001 | 0.16 | 50.5 | 32.6 | 3.1 | 0.6 | Y: 0.041 | (N: 0.022) |
| | 17 | 0.02 | 0.21 | 3.8 | 0.013 | 0.0009 | 0.17 | 39.2 | 30.5 | 2.7 | — | Mg: 0.013 | (N: 0.026) |
| | 18 | 0.02 | 0.17 | 6.3 | 0.016 | 0.002 | 0.18 | 37.6 | 25.4 | 2.5 | 0.2 | Ca: 0.043 | (N: 0.021) |
| | 19 | 0.01 | 0.15 | 4.6 | 0.012 | 0.002 | 0.19 | 45.5 | 26.9 | 2.8 | — | Ti: 0.36 | (N: 0.025) |
| | 20 | 0.01 | 0.16 | 5.2 | 0.014 | 0.001 | 0.17 | 48.8 | 26.1 | 3.1 | — | Y: 0.025, Mg: 0.009 | (N: 0.016) |
| | 21 | 0.02 | 0.23 | 3.5 | 0.012 | 0.001 | 0.25 | 38.2 | 23.5 | 3.4 | — | La + Ce: 0.016, Ca: 0.023, Ti: 0.27 | (N: 0.023) |
| | 22 | 0.01 | 0.45 | 6.2 | 0.016 | 0.003 | 0.18 | 40.5 | 26.8 | 2.6 | 0.2 | Cu: 1.6, Ca: 0.009 | (N: 0.031) |
| | 23 | 0.01 | 0.38 | 7.3 | 0.023 | 0.001 | 0.09 | 33.5 | 29.8 | 1.9 | 2.5 | Cu: 1.3, Co: 1.7, Y: 0.041, Mg: 0.009 | (N: 0.016) |
| | 24 | 0.007 | 0.26 | 4.6 | 0.003 | 0.002 | 0.14 | 45.9 | 25.3 | 3.1 | — | N: 0.27 | |
| | 25 | 0.03 | 0.25 | 10.2 | 0.011 | 0.0005 | 0.16 | 41.6 | 33.9 | 1.6 | 0.4 | N: 0.18, Cu: 1.8 | |
| | 26 | 0.01 | 0.38 | 15.8 | 0.016 | 0.0007 | 0.22 | 36.5 | 29.6 | — | 6.4 | N: 0.16, Y: 0.037 | |
| | 27 | 0.01 | 0.29 | 7.9 | 0.011 | 0.001 | 0.18 | 50.2 | 25.3 | 2.6 | — | N: 0.22, Mg: 0.014 | |
| | 28 | 0.02 | 0.16 | 5.6 | 0.009 | 0.001 | 0.16 | 47.5 | 28.4 | 3.0 | — | N: 0.25, La + Ce: 0.012, Ti: 0.05 | |
| | 29 | 0.02 | 0.14 | 4.3 | 0.014 | 0.003 | 0.15 | 38.1 | 30.9 | 1.6 | 0.7 | N: 0.16, Cu: 1.4, | |

TABLE 1-continued

| | Alloy No. | This invention (Weight %) | | | | | | | | | | | |
|---|---|---|---|---|---|---|---|---|---|---|---|---|---|
| | | C | Si | Mn | P | S | Sol.Al | Ni | Cr | Mo | W | Others | |
| | | | | | | | | | | | | Co: 1.8, Y: 0.012, Mg: 0.015 | |
| Comparative | 1 | 0.01 | 0.26 | 2.7* | 0.010 | 0.001 | 0.09 | 36.2 | 24.5* | 2.0* | 0.3* | — | (N: 0.011) |
| | 2 | 0.02 | 0.47 | 20.9* | 0.011 | 0.008* | 0.26 | 27.5 | 27.5 | 2.8 | — | — | (N: 0.022) |
| | 3 | 0.03 | 0.26 | 3.6* | 0.023 | 0.002 | 0.16 | 23.6* | 28.6 | 2.9 | 0.7 | — | (N: 0.018) |
| | 4 | 0.05 | 0.45 | 5.0 | 0.016 | 0.004 | 0.26 | 45.2 | 36.6* | 3.1 | — | — | (N: 0.024) |
| | 5 | 0.01 | 0.38 | 4.5 | 0.027 | 0.001 | 0.18 | 50.6 | 27.5* | 1.3* | — | — | (N: 0.016) |
| | 6 | 0.02 | 0.27 | 6.8 | 0.014 | 0.003 | 0.12 | 41.5 | 26.8* | — | 2.7* | — | (N: 0.025) |
| Conventional | 1 | 0.06 | 0.51 | 1.28 | 0.026 | 0.010 | — | 12.8 | 17.2 | 2.4 | — | — | (N: 0.012) |
| | 2 | 0.06 | 0.53 | 1.29 | 0.029 | 0.013 | — | 20.4 | 25.2 | — | — | Cu: 0.1 | (N: 0.015) |
| | 3 | 0.05 | 0.51 | 1.14 | 0.014 | 0.007 | 0.38 | 31.9 | 20.8 | — | — | Ti: 0.25 | (N: 0.014) |
| | 4 | 0.04 | 0.47 | 0.81 | 0.026 | 0.010 | — | 5.4 | 25.4 | 2.2 | — | | (N: 0.013) |

Note:
*Outside the range of this invention
Nitrogen amounts within the parentheses are those as an impurity.

TABLE 2

| | Alloy No. | Cracking during hot forging | Cracking in $H_2S$-10 atm $CO_2$ in 20% NaCl (at 150° C.) $H_2S$ 0.1 atm | $H_2S$ 1 atm | $H_2S$ 15 atm | 0.2% offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|---|
| This invention | 1 | | | | | 87.7 | 91.2 | 18 | 80 | 22.9 |
| | 2 | | | | | 94.5 | 96.8 | 13 | 75 | 18.6 |
| | 3 | | | | | 88.5 | 91.0 | 15 | 70 | 14.6 |
| | 4 | | | | | 86.4 | 89.5 | 18 | 81 | 24.6 |
| | 5 | | | | | 83.6 | 89.3 | 21 | 80 | 24.1 |
| | 6 | | | | | 81.1 | 83.1 | 18 | 82 | 26.5 |
| | 7 | | | | | 86.2 | 90.3 | 18 | 79 | 20.6 |
| | 8 | | | | | 84.5 | 88.6 | 13 | 76 | 19.3 |
| | 9 | | | | | 82.3 | 85.5 | 16 | 79 | 25.6 |
| | 10 | O | O | O | O | 79.4 | 82.5 | 18 | 80 | 24.6 |
| | 11 | | | | | 83.4 | 87.2 | 14 | 76 | 19.3 |
| | 12 | | | | | 82.4 | 85.4 | 19 | 79 | 23.7 |
| | 13 | | | | | 92.5 | 95.6 | 12 | 72 | 16.4 |
| | 14 | | | | | 90.2 | 93.7 | 16 | 75 | 20.4 |
| | 15 | | | | | 85.4 | 88.8 | 16 | 72 | 17.7 |
| | 16 | | | | | 82.1 | 87.9 | 18 | 73 | 19.7 |
| | 17 | | | | | 88.9 | 93.4 | 16 | 75 | 18.6 |
| | 18 | | | | | 80.3 | 83.5 | 16 | 76 | 19.9 |
| | 19 | | | | | 80.9 | 84.8 | 15 | 75 | 19.6 |
| | 20 | | | | | 81.6 | 85.2 | 16 | 77 | 20.4 |
| | 21 | | | | | 83.5 | 87.3 | 14 | 72 | 16.5 |
| This invention | 22 | | | | | 79.9 | 84.5 | 16 | 73 | 16.2 |
| | 23 | | | | | 90.4 | 92.7 | 13 | 74 | 16.8 |
| | 24 | O | O | O | O | 104.3 | 108.6 | 14 | 72 | 16.6 |
| | 25 | | | | | 107.5 | 109.9 | 11 | 69 | 13.2 |
| | 26 | | | | | 104.5 | 108.6 | 12 | 73 | 12.2 |
| | 27 | | | | | 102.6 | 108.3 | 26 | 74 | 27.3 |
| | 28 | | | | | 106.3 | 110.2 | 25 | 71 | 23.6 |
| | 29 | | | | | 99.7 | 106.0 | 16 | 75 | 18.1 |
| Comparative | 1 | O | O | O | X | 80.2 | 84.2 | 14 | 75 | 18.7 |
| | 2 | X | — | — | — | — | — | — | — | — |
| | 3 | O | O | O | X | 79.5 | 82.3 | 14 | 76 | 16.9 |
| | 4 | X | — | — | — | — | — | — | — | — |
| | 5 | O | X | X | X | 76.3 | 80.6 | 17 | 81 | 23.9 |
| | 6 | | | | | 79.6 | 81.3 | 15 | 80 | 24.4 |
| Conventional | 1 | | X | | | 72.3 | 73.6 | 18 | 80 | 25.6 |
| | 2 | O | | X | X | 70.9 | 74.7 | 20 | 82 | 16.8 |
| | 3 | | O | | | 72.6 | 75.1 | 17 | 81 | 24.6 |
| | 4 | | | | | 90.9 | 92.9 | 16 | 78 | 18.9 |

Note:
Alloy Nos. correspond to those in Table 1.

TABLE 3

| | Alloy No. | This invention (weight %) C | Si | Mn | P | S | Sol.Al | Ni | Cr | Mo | W | Others | |
|---|---|---|---|---|---|---|---|---|---|---|---|---|---|
| This invention | 1 | 0.01 | 0.38 | 3.1 | 0.018 | 0.002 | 0.11 | 40.3 | 28.1 | 6.2 | — | — | (N: 0.021) |
| | 2 | 0.02 | 0.25 | 11.7 | 0.021 | 0.001 | 0.13 | 45.7 | 24.7 | 5.9 | — | — | (N: 0.017) |
| | 3 | 0.02 | 0.27 | 19.3 | 0.014 | 0.002 | 0.13 | 40.1 | 25.1 | 3.7 | 1.6 | — | (N: 0.015) |
| | 4 | 0.01 | 0.05 | 9.6 | 0.016 | 0.001 | 0.12 | 20.7 | 24.6 | 7.3 | — | — | (N: 0.010) |
| | 5 | 0.01 | 0.16 | 8.2 | 0.017 | 0.002 | 0.14 | 59.1 | 24.6 | 1.5 | 8.2 | — | (N: 0.026) |
| | 6 | 0.02 | 0.12 | 4.3 | 0.012 | 0.001 | 0.10 | 50.6 | 23.1 | 5.1 | — | — | (N: 0.031) |
| | 7 | 0.01 | 0.22 | 3.6 | 0.003 | 0.0004 | 0.08 | 27.5 | 29.3 | 3.7 | 0.9 | — | (N: 0.026) |
| | 8 | 0.03 | 0.24 | 16.5 | 0.009 | 0.001 | 0.16 | 35.4 | 28.1 | 4.2 | — | — | (N: 0.011) |
| | 9 | 0.01 | 0.18 | 4.2 | 0.018 | 0.001 | 0.17 | 40.2 | 23.5 | 7.9 | — | — | (N: 0.018) |
| | 10 | 0.03 | 0.19 | 5.6 | 0.016 | 0.002 | 0.25 | 33.1 | 29.2 | 3.2 | 6.0 | — | (N: 0.012) |
| | 11 | 0.01 | 0.11 | 4.9 | 0.012 | 0.001 | 0.22 | 25.6 | 29.1 | — | 8.7 | — | (N: 0.009) |
| | 12 | 0.04 | 0.07 | 10.6 | 0.009 | 0.0006 | 0.22 | 52.6 | 23.3 | 0.2 | 15.4 | — | (N: 0.022) |
| | 13 | 0.01 | 0.12 | 3.8 | 0.013 | 0.001 | 0.23 | 43.8 | 29.6 | 5.9 | — | Cu: 1.8 | (N: 0.018) |
| | 14 | 0.01 | 0.16 | 4.1 | 0.016 | 0.002 | 0.22 | 38.6 | 27.6 | 3.7 | 2.8 | Co: 1.9 | (N: 0.016) |
| | 15 | 0.02 | 0.17 | 13.8 | 0.014 | 0.002 | 0.20 | 34.3 | 25.2 | 6.3 | — | La + Ce: 0.021 | (N: 0.016) |
| | 16 | 0.01 | 0.13 | 6.5 | 0.002 | 0.001 | 0.26 | 31.4 | 27.5 | 4.6 | 1.2 | Y: 0.043 | (N: 0.012) |
| | 17 | 0.01 | 0.09 | 7.0 | 0.010 | 0.001 | 0.25 | 46.3 | 24.6 | 5.9 | — | Mg: 0.012 | (N: 0.021) |
| | 18 | 0.02 | 0.12 | 6.7 | 0.013 | 0.004 | 0.20 | 41.2 | 29.8 | 2.7 | 4.1 | Ca: 0.028 | (N: 0.022) |
| | 19 | 0.01 | 0.11 | 5.9 | 0.019 | 0.003 | 0.13 | 50.1 | 23.5 | 5.5 | — | Ti: 0.35 | (N: 0.014) |
| | 20 | 0.02 | 0.13 | 4.6 | 0.017 | 0.003 | 0.14 | 52.7 | 24.6 | 6.0 | — | Y: 0.022, Mg: 0.008 | (N: 0.016) |
| | 21 | 0.02 | 0.12 | 3.9 | 0.022 | 0.002 | 0.13 | 49.6 | 23.2 | 5.3 | — | La + Ce: 0.017, Ca: 0.012, Ti: 0.03 | (N: 0.021) |
| | 22 | 0.01 | 0.25 | 4.3 | 0.018 | 0.002 | 0.14 | 46.7 | 26.8 | 6.2 | — | Cu: 1.4, Ca: 0.038 | (N: 0.016) |
| | 23 | 0.01 | 0.23 | 3.2 | 0.018 | 0.003 | 0.22 | 45.3 | 25.4 | 5.9 | 0.3 | Cu: 1.7, Co: 1.2, Y: 0.036, Mg: 0.010 | (N: 0.023) |
| | 24 | 0.04 | 0.26 | 11.2 | 0.014 | 0.001 | 0.25 | 55.3 | 28.6 | 1.9 | 5.2 | N: 0.27 | |
| | 25 | 0.02 | 0.06 | 4.2 | 0.012 | 0.001 | 0.21 | 39.2 | 26.8 | 3.9 | 1.3 | N: 0.18, Cu: 1.3 | |
| | 26 | 0.01 | 0.13 | 6.6 | 0.018 | 0.002 | 0.19 | 38.9 | 24.5 | 3.6 | 2.7 | N: 0.16, Y: 0.033 | |
| | 27 | 0.02 | 0.15 | 5.4 | 0.024 | 0.002 | 0.22 | 43.4 | 23.8 | 4.7 | 1.1 | N: 0.12, Mg: 0.014 | |
| | 28 | 0.03 | 0.14 | 8.6 | 0.015 | 0.0006 | 0.19 | 50.1 | 27.7 | 4.6 | — | N: 0.23, La + Ce: 0.020, Ti: 0.07 | |
| | 29 | 0.01 | 0.17 | 3.5 | 0.014 | 0.001 | 0.09 | 45.6 | 29.1 | 4.2 | — | N: 0.19, Cu: 1.3, Co: 1.2, Y: 0.021, Mg: 0.011 | |
| Comparative | 1 | 0.01 | 0.25 | 2.4* | 0.019 | 0.002 | 0.12 | 37.8 | 23.5* | 4.3* | — | — | (N: 0.032) |
| | 2 | 0.02 | 0.23 | 21.1* | 0.027 | 0.011* | 0.18 | 21.6 | 24.5 | 6.1 | 0.2 | — | (N: 0.026) |
| | 3 | 0.03 | 0.27 | 6.3 | 0.024 | 0.005 | 0.25 | 18.8* | 27.6 | 4.8 | 1.3 | — | (N: 0.024) |
| | 4 | 0.06 | 0.33 | 7.2 | 0.016 | 0.003 | 0.23 | 40.3 | 31.6* | 4.7 | — | — | (N: 0.018) |
| | 5 | 0.02 | 0.28 | 5.9 | 0.019 | 0.002 | 0.24 | 49.4 | 26.4* | 3.3* | — | — | (N: 0.016) |
| | 6 | 0.02 | 0.24 | 3.7 | 0.015 | 0.002 | 0.22 | 38.3 | 25.4* | — | 7.1* | — | (N: 0.019) |

Note:
*Outside the range of this invention
Nitrogen amounts within the parentheses are those as an impurity.

TABLE 2

| | Alloy No. | Cracking during hot forging | Cracking in $H_2S$-10 atm $CO_2$ in 20% NaCl (at 200° C.) $H_2S$ 0.1 atm | $H_2S$ 1 atm | $H_2S$ 15 atm | 0.2% offset strength (kgf/mm²) | Tensile strength (kgf/mm²) | Elongation (%) | Reduction of area (%) | Impact value (kg · m/mm² at 0° C.) |
|---|---|---|---|---|---|---|---|---|---|---|
| This invention | 1 | | | | | 95.4 | 102.5 | 12 | 54 | 7.6 |
| | 2 | | | | | 95.3 | 99.5 | 16 | 75 | 20.4 |
| | 3 | | | | | 92.3 | 96.5 | 15 | 75 | 18.9 |
| | 4 | | | | | 101.8 | 107.2 | 9 | 54 | 8.2 |
| | 5 | | | | | 97.0 | 102.4 | 16 | 74 | 19.8 |
| | 6 | | | | | 91.3 | 95.5 | 17 | 78 | 22.3 |
| | 7 | | | | | 85.5 | 88.0 | 14 | 68 | 13.9 |
| | 8 | | | | | 101.4 | 108.5 | 9 | 46 | 7.7 |
| | 9 | | | | | 89.4 | 92.3 | 15 | 78 | 8.3 |
| | 10 | | | | | 95.4 | 100.3 | 9 | 42 | 6.8 |
| | 11 | O | O | O | O | 98.8 | 104.2 | 8 | 39 | 7.3 |
| | 12 | | | | | 97.1 | 102.7 | 14 | 71 | 16.8 |
| | 13 | | | | | 96.4 | 101.3 | 10 | 56 | 8.7 |
| | 14 | | | | | 98.8 | 104.2 | 9 | 39 | 5.9 |
| | 15 | | | | | 96.4 | 98.4 | 12 | 72 | 9.3 |
| | 16 | | | | | 98.4 | 106.4 | 8.7 | 46 | 6.9 |
| | 17 | | | | | 96.3 | 102.1 | 14 | 68 | 14.7 |
| | 18 | | | | | 94.4 | 100.6 | 12 | 58 | 9.6 |
| | 19 | | | | | 93.3 | 97.5 | 16 | 76 | 20.3 |
| | 20 | | | | | 96.1 | 101.6 | 15 | 72 | 16.7 |

| Alloy | Cracking during hot | Cracking in $H_2S$-10 atm $CO_2$ in 20% NaCl (at 200° C.) $H_2S$ | $H_2S$ | $H_2S$ | 0.2% offset yield strength | Tensile strength | Elongation | Reduction of area | Impact value (kg · m/cm² |
|---|---|---|---|---|---|---|---|---|---|

TABLE 2-continued

| | No. | forging | 0.1 atm | 1 atm | 15 atm | (kgf/mm²) | (kgf/mm²) | (%) | (%) | at 0° C.) |
|---|---|---|---|---|---|---|---|---|---|---|
| This invention | 21 | | | | | 97.0 | 99.8 | 13 | 74 | 17.6 |
| | 22 | | | | | 90.0 | 95.3 | 17 | 76 | 17.7 |
| | 23 | | | | | 91.4 | 94.6 | 15 | 77 | 11.3 |
| | 24 | O | O | O | O | 105.6 | 111.3 | 18 | 73 | 18.4 |
| | 25 | | | | | 94.4 | 99.5 | 18 | 81 | 22.3 |
| | 26 | | | | | 94.0 | 97.8 | 25 | 78 | 26.2 |
| | 27 | | | | | 96.8 | 101.3 | 12 | 70 | 17.9 |
| | 28 | | | | | 105.1 | 112.7 | 22 | 74 | 18.2 |
| | 29 | | | | | 103.4 | 109.5 | 17 | 71 | 16.1 |
| Comparative | 1 | O | O | O | X | 80.3 | 84.3 | 15 | 79 | 22.3 |
| | 2 | X | — | — | — | — | — | — | — | — |
| | 3 | O | O | X | X | 99.4 | 105.5 | 10 | 48 | 6.7 |
| | 4 | | — | — | — | — | — | — | — | — |
| | 5 | X | X | X | O | 79.3 | 84.1 | 15 | 75 | 16.9 |
| | 6 | | | | | 79.4 | 82.5 | 17 | 81 | 24.6 |
| Conventional** | 1 | | | | | | | | | |
| | 2 | O | X | X | X | | | | | |
| | 3 | | | | | | | | | |
| | 4 | | O | | | | | | | |

Note: Alloy Nos. correspond to those in Table 3.
**The same as in Table 1.

TABLE 5

| | Alloy No. | This invention (weight %) | | | | | | | | | | | |
|---|---|---|---|---|---|---|---|---|---|---|---|---|---|
| | | C | Si | Mn | P | S | Sol.Al | Ni | Cr | Mo | W | Others | |
| This invention | 1 | 0.01 | 0.09 | 3.2 | 0.016 | 0.001 | 0.15 | 40.7 | 20.4 | 9.5 | — | — | (N: 0.016) |
| | 2 | 0.03 | 0.14 | 11.5 | 0.023 | 0.001 | 0.17 | 55.2 | 25.2 | 10.1 | — | — | (N: 0.014) |
| | 3 | 0.02 | 0.12 | 19.2 | 0.018 | 0.003 | 0.17 | 40.1 | 19.8 | 6.8 | 5.2 | — | (N: 0.019) |
| | 4 | 0.01 | 0.16 | 19.6 | 0.009 | 0.002 | 0.24 | 20.9 | 25.4 | 9.6 | — | — | (N: 0.022) |
| | 5 | 0.01 | 0.24 | 3.7 | 0.021 | 0.001 | 0.09 | 59.0 | 17.3 | 6.3 | 6.7 | — | (N: 0.026) |
| | 6 | 0.02 | 0.26 | 11.7 | 0.019 | 0.001 | 0.18 | 25.6 | 15.8 | 11.0 | — | — | (N: 0.031) |
| | 7 | 0.02 | 0.21 | 6.5 | 0.005 | 0.001 | 0.16 | 30.5 | 28.3 | 7.2 | 5.8 | — | (N: 0.018) |
| | 8 | 0.03 | 0.38 | 8.2 | 0.017 | 0.003 | 0.19 | 31.6 | 29.2 | 8.5 | — | — | (N: 0.014) |
| | 9 | 0.01 | 0.36 | 9.9 | 0.011 | 0.002 | 0.12 | 26.8 | 16.1 | 11.4 | — | — | (N: 0.017) |
| | 10 | 0.02 | 0.42 | 4.6 | 0.023 | 0.001 | 0.14 | 41.2 | 18.4 | 5.1 | 9.8 | — | (N: 0.012) |
| | 11 | 0.02 | 0.16 | 5.2 | 0.016 | 0.001 | 0.15 | 43.6 | 27.1 | — | 16.8 | — | (N: 0.019) |
| | 12 | 0.01 | 0.14 | 3.9 | 0.004 | 0.0003 | 0.13 | 51.3 | 15.6 | 0.4 | 23.1 | — | (N: 0.023) |
| | 13 | 0.02 | 0.12 | 18.6 | 0.008 | 0.002 | 0.25 | 22.6 | 16.2 | 7.6 | 3.8 | Cu: 1.8 | (N: 0.024) |
| | 14 | 0.02 | 0.08 | 6.5 | 0.018 | 0.001 | 0.18 | 27.2 | 16.4 | 9.6 | — | Co: 1.9 | (N: 0.021) |
| | 15 | 0.04 | 0.17 | 10.6 | 0.020 | 0.002 | 0.22 | 30.6 | 20.6 | 10.1 | — | La + Ce: 0.020 | (N: 0.020) |
| | 16 | 0.01 | 0.10 | 4.1 | 0.003 | 0.001 | 0.19 | 38.2 | 19.8 | 9.2 | 1.6 | Y: 0.046 | (N: 0.023) |
| | 17 | 0.01 | 0.19 | 3.6 | 0.016 | 0.003 | 0.27 | 46.5 | 21.2 | 8.8 | 1.3 | Mg: 0.013 | (N: 0.019) |
| | 18 | 0.01 | 0.22 | 5.2 | 0.015 | 0.002 | 0.19 | 40.2 | 25.6 | 7.9 | 2.1 | Ca: 0.024 | (N: 0.018) |
| | 19 | 0.02 | 0.24 | 3.1 | 0.023 | 0.002 | 0.23 | 55.6 | 24.8 | 10.3 | — | Ti: 0.41 | (N: 0.014) |
| | 20 | 0.02 | 0.21 | 5.3 | 0.019 | 0.001 | 0.21 | 39.6 | 27.2 | 9.8 | — | Y: 0.035, Mg: 0.009 | (N: 0.016) |
| | 21 | 0.01 | 0.18 | 3.3 | 0.019 | 0.001 | 0.09 | 38.2 | 16.5 | 10.2 | — | La + Ce: 0.011, Ca: 0.016, Ti: 0.33 | (N: 0.019) |
| | 22 | 0.02 | 0.14 | 4.9 | 0.023 | 0.002 | 0.18 | 36.3 | 17.2 | 9.8 | 1.3 | Cu: 1.9, Ca: 0.034 | (N: 0.021) |
| | 23 | 0.01 | 0.15 | 3.8 | 0.013 | 0.001 | 0.25 | 40.9 | 16.9 | 9.6 | — | Cu: 1.6, Co: 1.8, Y: 0.035, Mg: 0.014 | (N: 0.024) |
| | 24 | 0.01 | 0.36 | 5.4 | 0.003 | 0.001 | 0.19 | 42.5 | 25.6 | 7.5 | 3.8 | N: 0.26 | |
| | 25 | 0.02 | 0.43 | 6.1 | 0.017 | 0.003 | 0.16 | 38.8 | 24.2 | 7.7 | 2.5 | N: 0.16, Cu: 1.3 | |
| | 26 | 0.03 | 0.27 | 8.6 | 0.014 | 0.001 | 0.12 | 37.5 | 23.9 | 8.5 | 0.6 | N: 0.14, Y: 0.046 | |
| | 27 | 0.02 | 0.16 | 12.4 | 0.020 | 0.002 | 0.11 | 35.2 | 20.2 | 10.6 | — | N: 0.21, Mg: 0.013 | |
| | 28 | 0.01 | 0.19 | 3.4 | 0.018 | 0.002 | 0.16 | 46.5 | 28.7 | 9.1 | — | N: 0.18, La + Ce: 0.021, Ti: 0.04 | |
| | 29 | 0.02 | 0.12 | 5.6 | 0.014 | 0.002 | 0.14 | 30.3 | 27.6 | 4.5 | 7.8 | N: 0.16, Cu: 1.4, Co: 1.6, Y: 0.025, Mg: 0.014 | |
| Comparative | 1 | 0.02 | 0.18 | 2.1* | 0.015 | 0.002 | 0.13 | 35.6 | 15.6* | 7.2* | 1.2* | — | (N: 0.026) |
| | 2 | 0.03 | 0.16 | 21.8* | 0.027 | 0.001 | 0.12 | 26.8 | 17.2* | 8.1* | — | — | (N: 0.024) |
| | 3 | 0.04 | 0.38 | 5.9* | 0.019 | 0.003 | 0.15 | 18.8* | 25.6 | 9.3 | — | — | (N: 0.016) |
| | 4 | 0.01 | 0.25 | 6.8 | 0.021 | 0.011* | 0.14 | 37.2 | 31.6* | 7.5 | 0.9 | — | (N: 0.015) |
| | 5 | 0.02 | 0.17 | 3.5 | 0.018 | 0.003 | 0.09 | 43.2 | 28.6* | 7.2* | — | — | (N: 0.019) |
| | 6 | 0.02 | 0.18 | 9.6 | 0.012 | 0.002 | 0.11 | 38.6 | 25.6* | — | 15.1* | — | (N: 0.017) |

Note: *Outside the range of this invention.
Nitrogen amounts within the parentheses are those as an impurity.

| Alloy No. | Cracking during hot forging | Cracking in $H_2S$-10 atm $CO_2$ in 20% NaCl (at 300° C.) $H_2S$ 0.1 atm | $H_2S$ 1 atm | $H_2S$ 15 atm | 0.2% offset yield strength (kgf/mm²) | Tensile Strength (kgf/mm²) | Elongation (%) | Reduction of area (%) | Impact value (kg · m/cm² at 0° C.) |
|---|---|---|---|---|---|---|---|---|---|

-continued

| | | | | | | | | | | |
|---|---|---|---|---|---|---|---|---|---|---|
| This invention | 1 | | | | | 88.4 | 92.8 | 15 | 63 | 9.5 |
| | 2 | | | | | 93.4 | 101.0 | 20 | 75 | 20.3 |
| | 3 | | | | | 96.4 | 100.8 | 15 | 63 | 10.6 |
| | 4 | | | | | 91.3 | 95.9 | 12 | 54 | 7.3 |
| | 5 | | | | | 89.8 | 94.6 | 19 | 78 | 24.4 |
| | 6 | | | | | 84.1 | 88.9 | 13 | 60 | 10.3 |
| | 7 | | | | | 86.3 | 90.9 | 10 | 46 | 5.7 |
| | 8 | | | | | 86.8 | 93.6 | 20 | 74 | 17.6 |
| | 9 | | | | | 83.1 | 86.9 | 14 | 60 | 9.1 |
| | 10 | O | O | O | O | 88.4 | 92.8 | 14 | 63 | 9.4 |
| | 11 | | | | | 86.5 | 93.5 | 18 | 71 | 14.6 |
| | 12 | | | | | 86.9 | 90.7 | 18 | 76 | 21.4 |
| | 13 | | | | | 83.6 | 85.7 | 16 | 79 | 23.0 |
| | 14 | | | | | 82.1 | 85.9 | 14 | 60 | 14.5 |
| | 15 | | | | | 90.4 | 94.8 | 13 | 63 | 9.6 |
| | 16 | | | | | 88.8 | 94.6 | 13 | 60 | 7.4 |
| | 17 | | | | | 87.1 | 92.0 | 18 | 78 | 20.6 |
| | 18 | | | | | 89.4 | 92.3 | 15 | 78 | 9.3 |
| | 19 | | | | | 91.4 | 98.0 | 22 | 77 | 23.3 |
| | 20 | | | | | 84.9 | 92.5 | 19 | 70 | 18.9 |

| | Alloy No. | Cracking during hot forging | Cracking in $H_2S$-10 atm $CO_2$ in 20% NaCl (at 300° C.) $H_2S$ 0.1 atm | $H_2S$ 1 atm | $H_2S$ 15 atm | 0.2% offset yield strength | Tensile strength (kgf/mm$^2$) | Elongation (%) | Reduction of area (%) | Impact value (kg · m/cm$^2$ at 0° C.) |
|---|---|---|---|---|---|---|---|---|---|---|
| This invention | 21 | | | | | 81.4 | 86.0 | 17 | 74 | 18.1 |
| | 22 | | | | | 81.9 | 86.9 | 16 | 74 | 16.2 |
| | 23 | | | | | 88.8 | 94.6 | 13 | 60 | 9.3 |
| | 24 | | | | | 106.9 | 113.2 | 26 | 68 | 22.7 |
| | 25 | O | O | O | O | 101.4 | 104.6 | 13 | 71 | 7.9 |
| | 26 | | | | | 95.3 | 99.9 | 10 | 46 | 5.2 |
| | 27 | | | | | 101.4 | 105.9 | 12 | 60 | 7.5 |
| | 28 | | | | | 99.8 | 106.6 | 17 | 68 | 12.9 |
| | 29 | | | | | 96.3 | 100.9 | 11 | 52 | 5.1 |
| Comparative | 1 | | | O | | 78.6 | 80.7 | 16 | 79 | 20.3 |
| | 2 | O | O | | X | 83.5 | 87.4 | 15 | 70 | 16.0 |
| | 3 | | | X | | 84.3 | 88.9 | 8 | 39 | 1.3 |
| | 4 | X | — | — | — | — | — | — | — | — |
| | 5 | O | O | O | X | 89.5 | 91.8 | 13 | 75 | 18.6 |
| | 6 | | | | | 79.4 | 82.5 | 15 | 75 | 14.9 |
| Conventional** | 1 | | | | | | | | | |
| | 2 | | | | | | | | | |
| | 3 | O | X | X | X | | | | | |
| | 4 | | | | | | | | | |

Note: Alloy Nos. correspond to those in Table 5.
**The same as in Table 1.

As has been described thoroughly hereinbefore, the alloy of this invention is superior in its high level of mechanical strength and resistance to stress corrosion cracking and is especially useful for manufacturing casing, tubing, liner and drill pipes for use in deep wells for producing petroleum crude oil, natural gas and geothermal water and other purposes.

What is claimed is:

1. An alloy for making high strength deep well casing and tubing having improved resistance to stress corrosion cracking at temperatures of 150° C. or less under $H_2S$-$CO_2$-$Cl^-$ conditions, the alloy composition consisting essentially of:

| | | | |
|---|---|---|---|
| C: | ≦ 0.1% | Si: | ≦ 1.0% |
| Mn: | 3-20% | P: | ≦ 0.030% |
| S: | ≦ 0.005% | N: | 0-0.30% |
| sol. | Al ≦ 0.5% | Ni: | 25-60% |
| Cr: | 22.5-35% | Mo: | 0-4% (excl.) |
| W: | 0-8% (excl.) | | |
| | Cr(%) + 10 Mo(%) + 5 W(%) ≧ 50% | | |
| | ½ Mn(%) + Ni(%) ≧ 35% | | |
| | 1.5% ≦ Mo(%) + ½ W(%) < 4% | | |
| Cu: | 0-2.0% | Co: | 0-2.0% |
| Rare Earths: | 0-0.10% | Y: | 0-0.20% |
| Mg: | 0-0.10% | Ti: | 0-0.5% |
| Ca: | 0-0.10% | | |

-continued

| |
|---|
| Fe and incidental impurities: balance. |

2. An alloy as defined in claim 1, in which the carbon content is not more than 0.05% and the manganese content is from 3% to 15%.

3. An alloy as defined in claim 1, in which the nickel content is from 35% to 60% and the chromium content is from 24% to 35%.

4. An alloy as defined in claim 1, in which the sulfur content is not more than 0.0007%.

5. An alloy as defined in claim 1, in which the phosphorous content is not more than 0.003%.

6. An alloy as defined in any one of claims 1-5, in which the nitrogen content is from 0.05% to 0.25%.

7. An alloy for making high strength deep well casing and tubing having improved resistance to stress corrosion cracking at temperatures of 200° C. or less under $H_2S$-$CO_2$-$Cl^-$ conditions, the alloy composition consisting essentially of:

| | | | |
|---|---|---|---|
| C: | ≦0.1% | Si: | ≦1.0% |
| Mn: | 3-20% | P: | ≦0.030% |
| S: | ≦0.005% | N: | 0-0.30% |
| sol.Al | ≦ 0.5% | Ni: | 20-60% |
| Cr: | 22.5-30% | Mo: | 0-8% (excl.) |

-continued

| | | | |
|---|---|---|---|
| W: | 0-16% (excl.) | | |
| | Cr (%) + 10Mo (%) + 5W (%) ≧ 70% | | |
| | ½Mn (%) + Ni (%) ≧ 25% | | |
| | 4% ≦ Mo (%) + ½W (%) < 8% | | |
| Cu: | 0-2.0% | Co: | 0-2.0% |
| Rare Earths: 0-0.10% | | | |
| | | Y: | 0-0.20% |
| Mg: | 0-0.10% | Ti: | 0-0.5% |
| Ca: | 0-0.10% | | |
| Fe and incidental impurities: balance. | | | |

8. An alloy as defined in claim 7, in which the carbon content is not more than 0.05% and the manganese content is from 3% to 15%.

9. An alloy as defined in claim 7, in which the nickel content is from 35% to 60% and the chromium content is from 24% to 30%.

10. An alloy as defined in claim 7, in which the sulfur content is not more than 0.0007%.

11. An alloy as defined in claim 7, in which the phosphorous content is not more than 0.003%.

12. An alloy as defined in any one of claims 7-11, in which the nitrogen content is from 0.05% to 0.25%.

13. An alloy for making high strength deep well casing and tubing having improved resistance to stress corrosion cracking at temperatures of 200° C. or more under $H_2S$-$CO_2$-Cl conditions, the alloy composition consisting essentially of:

| | | | |
|---|---|---|---|
| C: | ≧0.1% | Si: | ≦1.0% |
| Mn: | 3-20% | P: | ≦0.030% |
| S: | ≦0.005% | N: | 0-0.30% |
| sol.Al | ≦0.5% | Ni: | 20-60% |
| Cr: | 15-30% | Mo: | 0-12% |
| W: | 0-24% | | |
| | Cr (%) + 10Mo (%) + 5 W (%) ≧ 110% | | |
| | ½Mn (%) + Ni (%) ≧ 30% | | |
| | 8% ≦ Mo (%) + ½W (%) ≦ 12% | | |
| Cu: | 0-2.0% | Co: | 0-2.0% |
| Rare Earths: 0-0.10% | | Y: | 0-0.20% |
| Mg: | 0-0.10% | Ti: | 0-0.5% |
| Ca: | 0-0.10% | | |
| Fe and incidental impurities: balance. | | | |

14. An alloy as defined in claim 13, in which the carbon content is not more than 0.05% and the manganese content is from 3% to 15%.

15. An alloy as defined in claim 13, in which the nickel content is from 40% to 60%.

16. An alloy as defined in claim 13, in which the sulfur content is not more than 0.0007%.

17. An alloy as defined in claim 13, in which the phosphorous content is not more than 0.003%.

18. An alloy as defined in any one of claims 13-17, in which the nitrogen content is from 0.05% to 0.25%.

19. Deep well casing or tubing made of the alloy of claim 1.

20. Deep well casing or tubing made of the alloy of claim 7.

21. Deep well casing or tubing made of the alloy of claim 13.

* * * * *